US005735726A

United States Patent [19]

Cohen

[11] Patent Number: 5,735,726

[45] Date of Patent: Apr. 7, 1998

[54] ANIMATED SITTING AND STANDING SANTA CHARACTER

[75] Inventor: Seymour Cohen, Jericho, N.Y.

[73] Assignee: Telco Creations, Inc., Hicksville, N.Y.

[21] Appl. No.: 762,362

[22] Filed: Dec. 9, 1996

[51] Int. Cl.[6] ..... A63H 13/00

[52] U.S. Cl. ..... 446/298; 446/175; 446/354; 446/352; 40/414; 40/420

[58] Field of Search ..... 446/175, 330, 446/298, 352, 353, 354; 40/411, 414, 418, 420

[56] References Cited

U.S. PATENT DOCUMENTS

| | | | |
|---|---|---|---|
| 156,660 | 11/1874 | Clay . | |
| 569,219 | 10/1896 | Marshall | 446/298 |
| 2,254,091 | 8/1941 | Rossi | 40/420 |
| 2,273,836 | 2/1942 | Dale . | |
| 2,990,646 | 7/1961 | Berger | 446/353 |
| 3,036,404 | 5/1962 | Berger | 446/353 |
| 3,568,361 | 3/1971 | Bart . | |
| 3,568,362 | 3/1971 | Tomaro . | |
| 3,949,521 | 4/1976 | Heerlein . | |
| 4,073,088 | 2/1978 | Benny . | |
| 4,312,151 | 1/1982 | Terzian . | |
| 4,419,841 | 12/1983 | Huang . | |
| 4,778,432 | 10/1988 | Yeu | 446/300 |
| 4,955,844 | 9/1990 | Miller, Jr. | 446/330 |
| 5,176,560 | 1/1993 | Wetherell | 446/175 |
| 5,236,385 | 8/1993 | May | 446/330 |
| 5,247,753 | 9/1993 | Yang | 40/414 |
| 5,393,259 | 2/1995 | Lee | 446/298 |
| 5,416,995 | 5/1995 | Teng | 40/419 |

FOREIGN PATENT DOCUMENTS

| | | | |
|---|---|---|---|
| 2040703 | 9/1980 | United Kingdom | 446/354 |

*Primary Examiner*—Robert A. Hafer
*Assistant Examiner*—Jeffrey D. Carlson
*Attorney, Agent, or Firm*—Martin Smolowitz

[57] ABSTRACT

An animated character such as a Santa figure which is capable of moving repeatedly from a sitting to a standing position, and also producing vocal speaking or singing sounds synchronized with movements of the character. The character includes a body having a torso casing containing an electric motor and multiple gears, a head-piece capable of making side-to-side nodding motions, and multiple lever members provided on opposite sides of the casing and pivotably connected together so as to produce the repeated standing motions of the character from a sitting position. Operation of the character is controlled by an electric circuit which is operated either manually or from a light-sensitive switch which can sense motion of any nearby moving object or person and activate movements of the character.

9 Claims, 6 Drawing Sheets

ANIMATED SITTING AND STANDING SANTA CHARACTER

BACKGROUND OF INVENTION

This invention pertains to animated characters such as a Santa figure which is motor-operated and made capable of performing periodic sitting and standing movements while also producing vocal sounds synchronized to the movements.

Various animated characters are known and have been marketed, including animated dolls and some animated Santa figures. Arm and head movements of such characters are effected by internal gears and levers driven by an electric motor. For example, U.S. Pat. No. 2,273,836 to Dale discloses an animated doll device which has movable arm, head and mouth parts, but not movable legs. U.S. Pat. No. 3,568,361 to Bart et al discloses an animated doll which utilizes an oscillating arm motion to rise upwardly in a chair. U.S. Pat. No. 4,778,432 to Yeu discloses an animated doll sitting on a seat while turning its head and beating on a drum with both hands. U.S. Pat. No. 5,247,753 to Yang discloses a doll figure utilizing internal gears to effect arm and head motions. U.S. Pat. No. 5,393,259 to Lee discloses a Santa toy sleeping in a bed and actuated by battery-powered motor and internal gear means to periodically rise partially upwardly in the bed. U.S. Pat. No. 5,416,995 to Teng discloses an animated display doll device having two arms made pivotable by internal mechanical means. U.S. Pat. No. 4,073,088 to Beny et al discloses a toy doll having a body, a rotatably mounted head, and a pair of movable arms. The body torso portion utilizes an internal gear mechanism to move the head and arm, but no external levers are provided to actuate leg members to achieve sitting/standing movements for the doll. U.S. Pat. No. 4,312,150 to Terzian discloses an animated doll having movable arms and legs and capable of raising itself from a prone position to a sitting or standing position, but no means are provided which permit knee bending for legs of the doll to produce a standing position. Also, U.S. Pat. No. 5,176,560 to Wetherell et al discloses a free-standing dancing doll having a sound actuated motor and drive mechanism which rotate each of two drive rods and gear train to impart motions to various body parts including legs, arms and head. Although the doll legs are capable of making horizontal rotary movements at the knee to simulate dancing, it is not capable of making periodic sitting and standing movements.

Thus, although various animated characters have been previously developed, a need still exists in the market place for other animated toy figures which can exhibit clever realistic movements, including sitting and standing motions with vocal sounds being synchronized with such movements.

SUMMARY OF INVENTION

This invention provides an animated character such as a costumed Santa figure, which is electric motor powered and capable of performing periodic head movements and standing movements from a sitting position. The animated character can also provide vocal speaking sounds which are synchronized with the head and body movements. Such periodic head and body movements and vocal sounds for the character are provided by a control circuit which includes a battery-powered electric motor and speaker, and which can be initiated either manually or by a switch means which is sensitive to motions made by a nearby moving object or person. The sitting/standing motions of the animated character are produced by electric motor-driven gears located within a body torso member, which gears provide a side-to-side motions of the head and also drive dual external rotors each located externally on two opposite sides of the torso member. These dual rotors each drives a short horizontal first lever pivoted to the torso member, and also each drives an elongated vertical second lever which is pivotally attached at its upper end to the rotor, and is pivoted attached at its midpoint to the midpoint of a thigh lever member, and is also slidably attached at its lower end to a foot member of the animated character.

The animated character according to this invention comprises a body torso casing member containing multiple intermeshed gears driven by an electric motor mounted therein; and also has a first rotatable curved rod extending upwardly from the casing member; two rotors each located on an opposite side of the torso casing member, dual first levers each pivotally attached at one end onto the torso casing member and each attached at the lever other end to a corresponding rotor elongated second levers each pivotally attached at its upper end to the corresponding rotor and pivotally attached at an intermediate position to a thigh member and slidably attached at its lower end to a leg member at an elongated slot provided in each leg member. The electric motor located within the torso casing member is operated through a control circuit so as to rotate the first curved rod and the dual side rotors, and provide a pivotable motion for the elongated second lever, so as to produce a periodic standing motion for the character. An electric circuit board member controls the electric motor and a speaker element located either in a base member or in a chair resting on the base member.

This invention advantageously provides an animated character such as a Santa figure which is capable of periodically rising upwardly from a sitting position to a standing position, while nodding its head an making vocal speaking or singing sounds which are synchronized with the body movements. Such movements and vocal sounds can be initiated by either a manually-operated switch or by a motion-sensitive switch.

BRIEF DESCRIPTION OF DRAWINGS

This invention will be described further with reference to the following drawings, in which.

DESCRIPTION OF INVENTION

Figure 2:
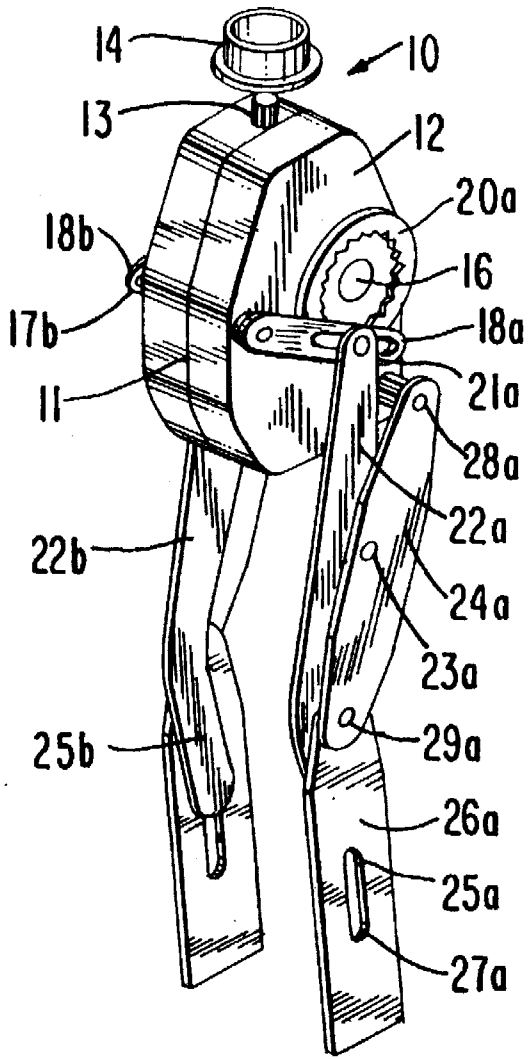
FIGS. 1 and 2 are isometric drawings each showing the main structural members of the animated character pivotally connected together and shown in successive sitting and standing positions, respectively.
Figure 1:
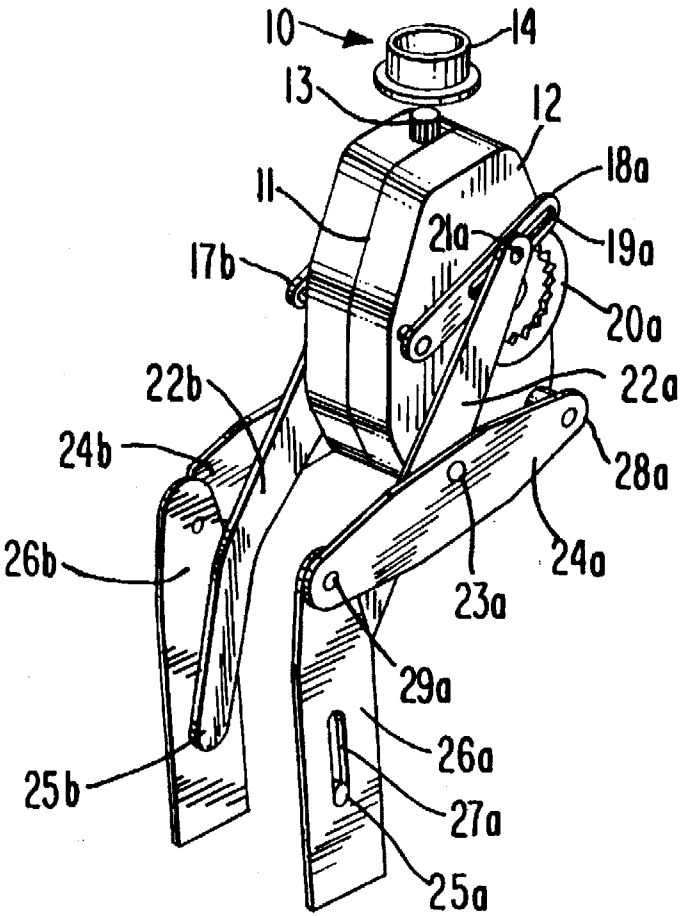

As is shown by FIGS. 1 and 2, an animated character such as a Santa figure utilizes an inner operating structure 10 including a casing 12 which is split vertically at mating joint 11. The casing 12 houses an electric drive motor and internal multiple intermeshing gears (not shown). A curved rotatable rod 13 extends upwardly from the casing 12 and is attached to a shaped head care member 14 of the operating structure 10. A central horizontal rotatable output shaft 16 extends outwardly from two opposite sides of the casing 12, and drives dual rotors 20*a* and 20*b*, each located on the opposite sides of the casing 12. The dual rotor 20*a* and 20*b* are each pivotally connected at its periphery to short first levers 18*a* and 18*b* respectively, which are pivotably attached at 17*a* and 17*b* to a forward edge of the casing 12 and contain slots 19*a* and 19*b*, respectively. Elongated actuating lever members 22*a* and 22*b* are each also pivotably attached at its upper end 21*a* and 22*b* to the first lever 18*a* and 18*b*, and are also attached to the periphery of rotors 20*a* and 20*b*, respectively. The elongated actuating lever 22*a* and 22*b* are each also pivotably attached at near its midpoint 23*a* and 23*b* to thigh levers 24*a* and 24*b*, and are also each slidably attached at its lower end 25*a* and 25*b* to vertically-oriented leg members 26*a* and 26*b* each having a central elongated slot 27*a* and 27*b*, in which a pin 25*a* and 25*b* each slides vertically. The two thigh levers 24*a* and 24*b* are each also pivotally attached at its upper end 28*a* and 28*b* to the casing 12, and is pivotally attached at its lower end 29*a* and 29*b* to the upper end of the leg members 26*a* and 26*b*.

As can be seen by comparing the FIGS. 1 and 2 drawings, it is apparent that when each of the side rotors 20*a* and 20*b* are rotated, the upper end of each elongated actuating lever 22*a* and 22*b* is moved up and down, and because the actuating levers are pivotably attached to the thigh levers 24*a* and 24*b* and are slidably attached to the leg members 26*a* and 26*b*, they act to move the casing 12 upward and downward relative to the stationary leg members. These actions enable the operating structure 10 and the animated character to rise from a sitting position to a standing position. Such upward and downward movements of the character are synchronized by the intermeshing gears provided in the casing 12 with side movements of the upper rotatable rod 13 and head core member 14 so as to provide nodding movements for the head of the character. The operating mechanism 10 can be covered by various costumes as desired for any animated character for which sequential sitting and standing motions are appropriate.

Figure 3:
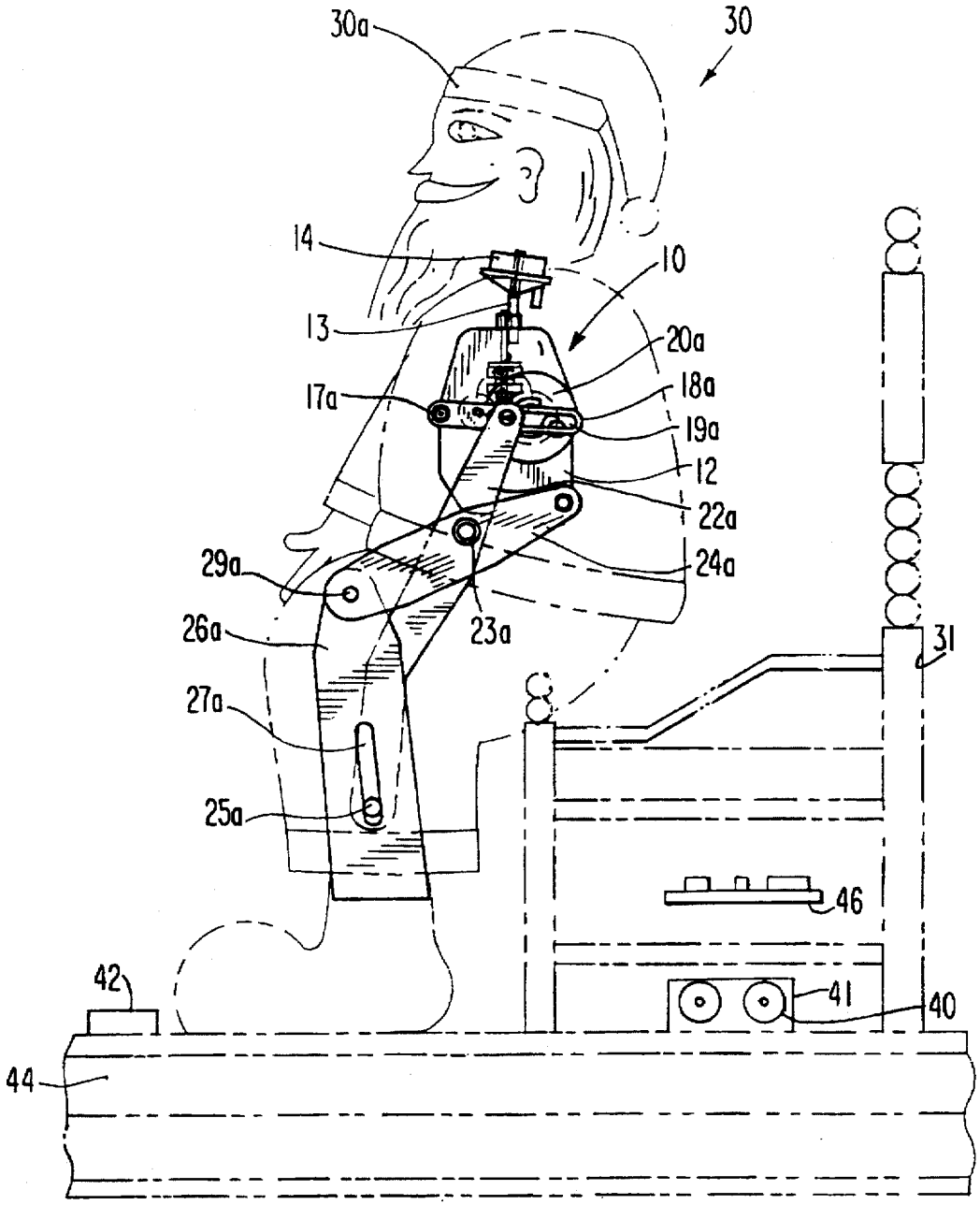
FIGS. 3 and 4 each show side elevation views of a Santa character having a body enclosing the structural members in successive sitting and standing positions from a chair.
Figure 4:
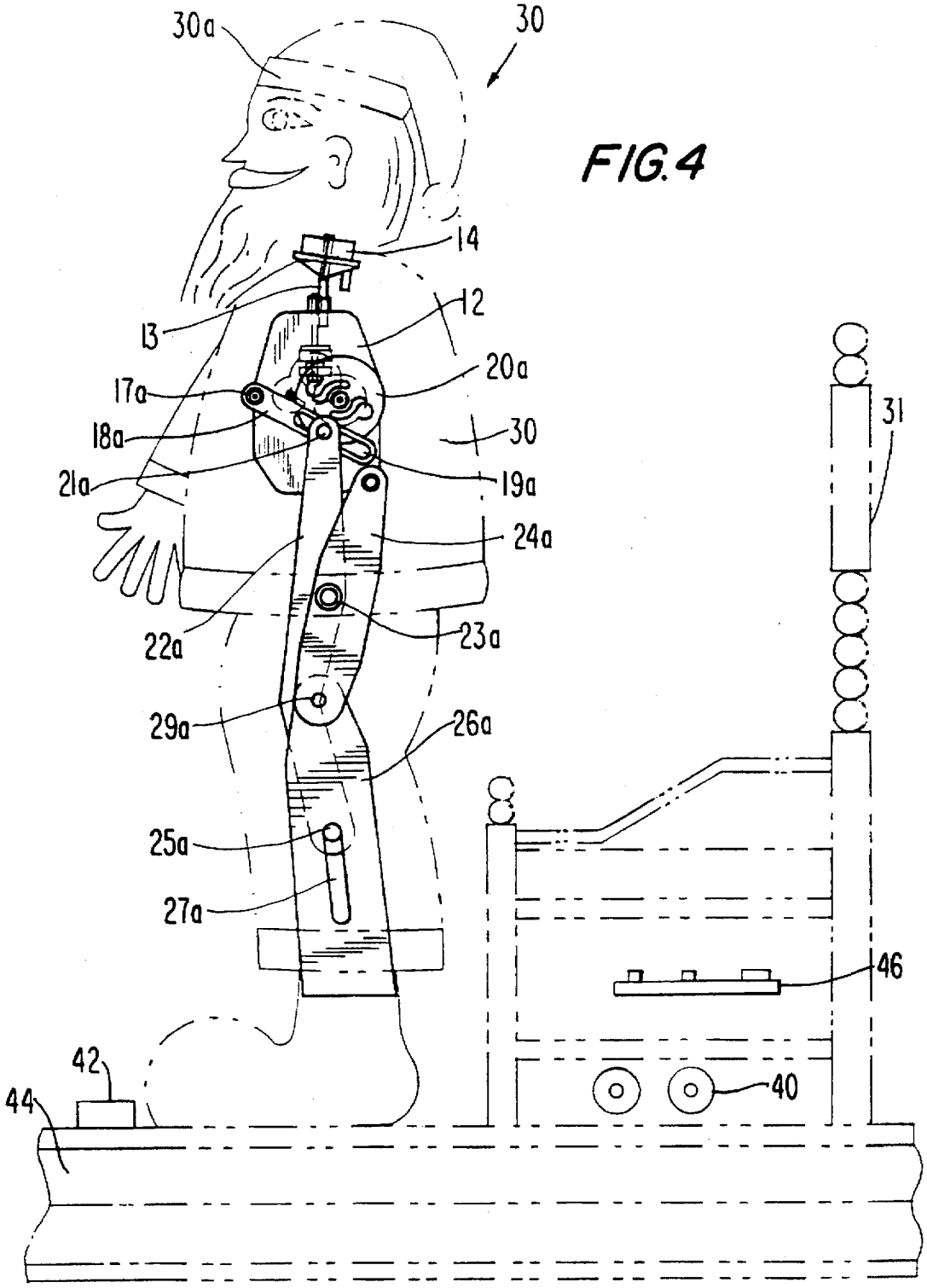
Figure 5:
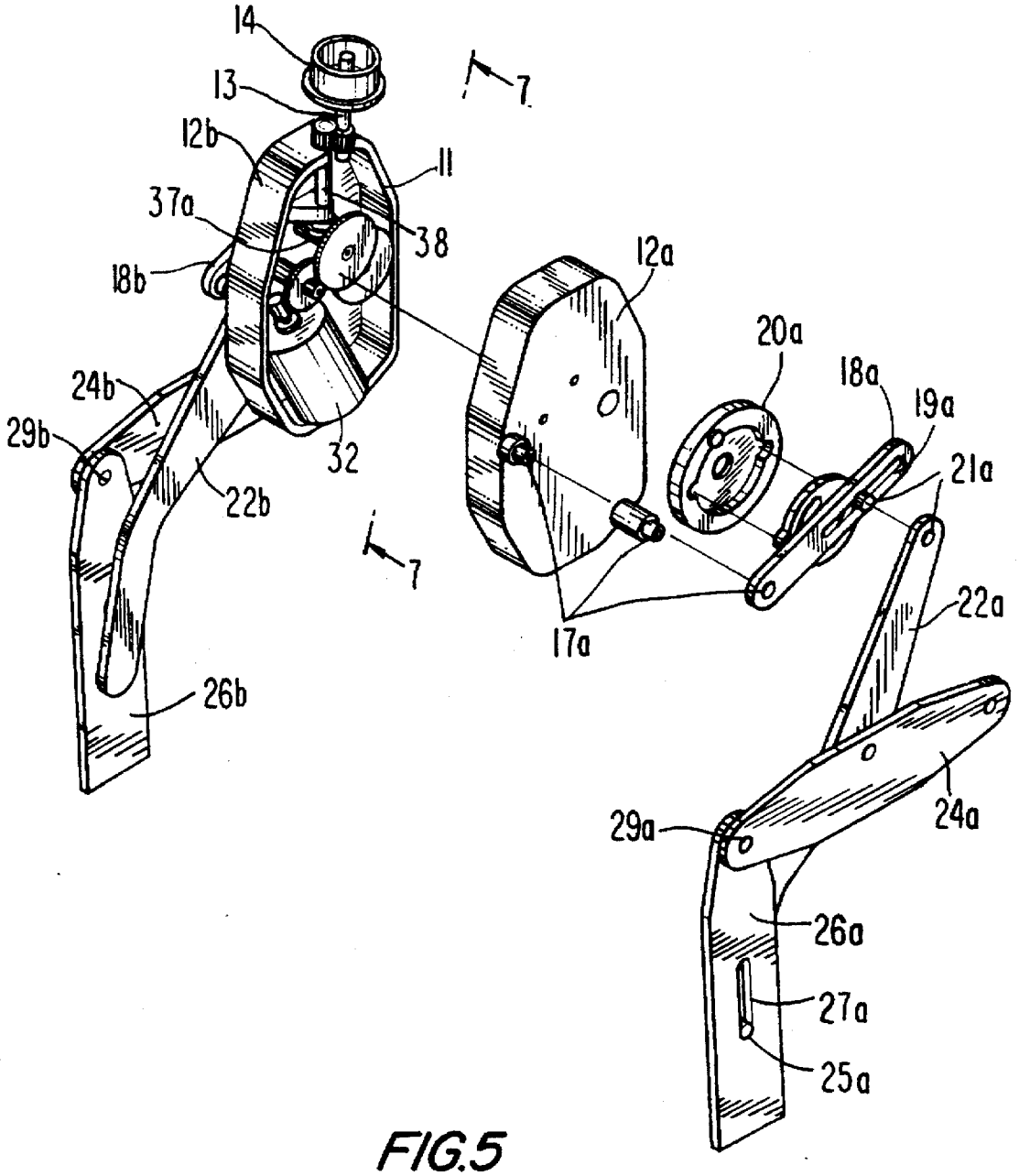
FIG. 5 and 6 each show an exploded view of the various structural members of the animated character when in successive sitting and standing positions.
Figure 6:
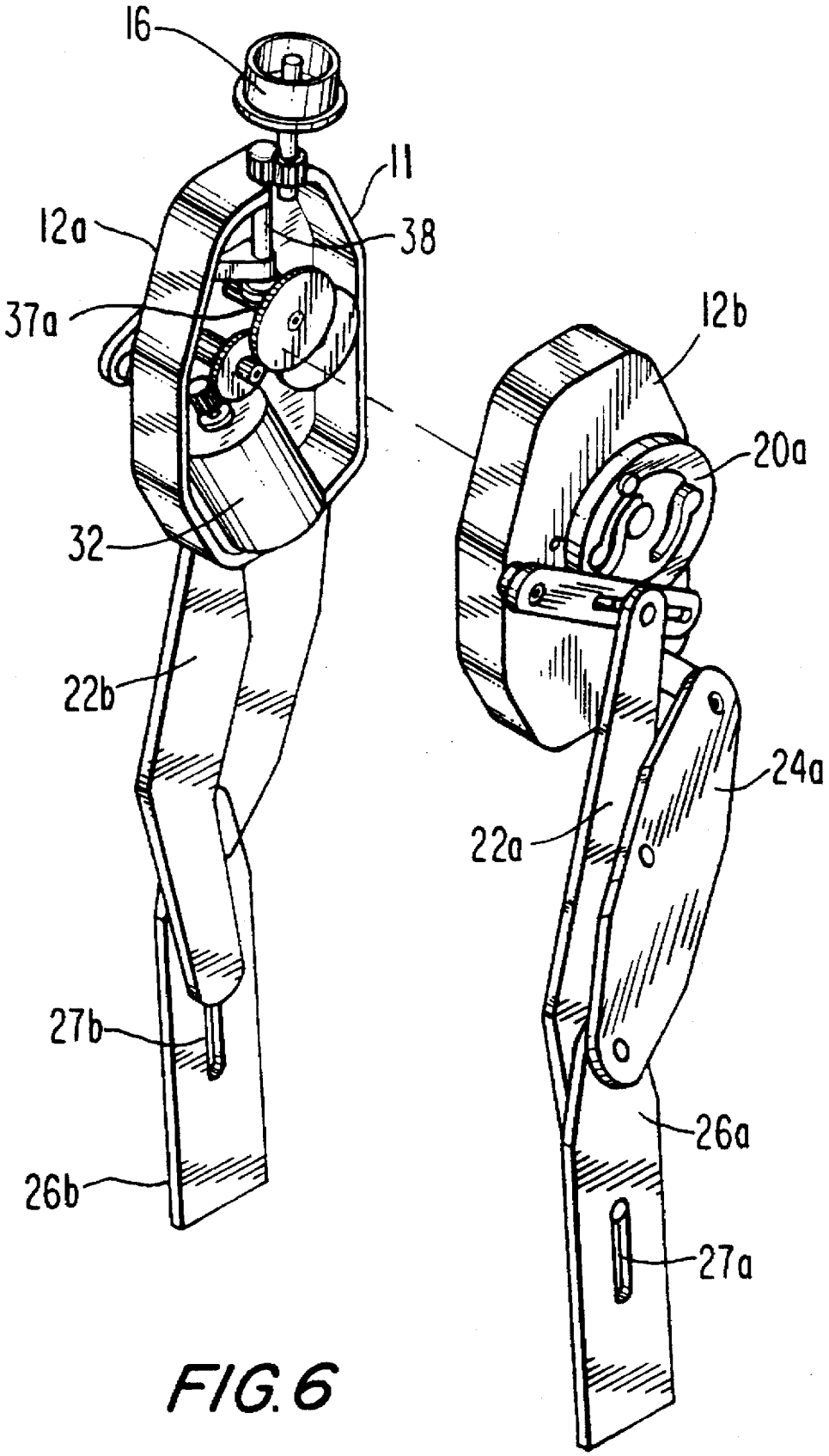
Figure 7:
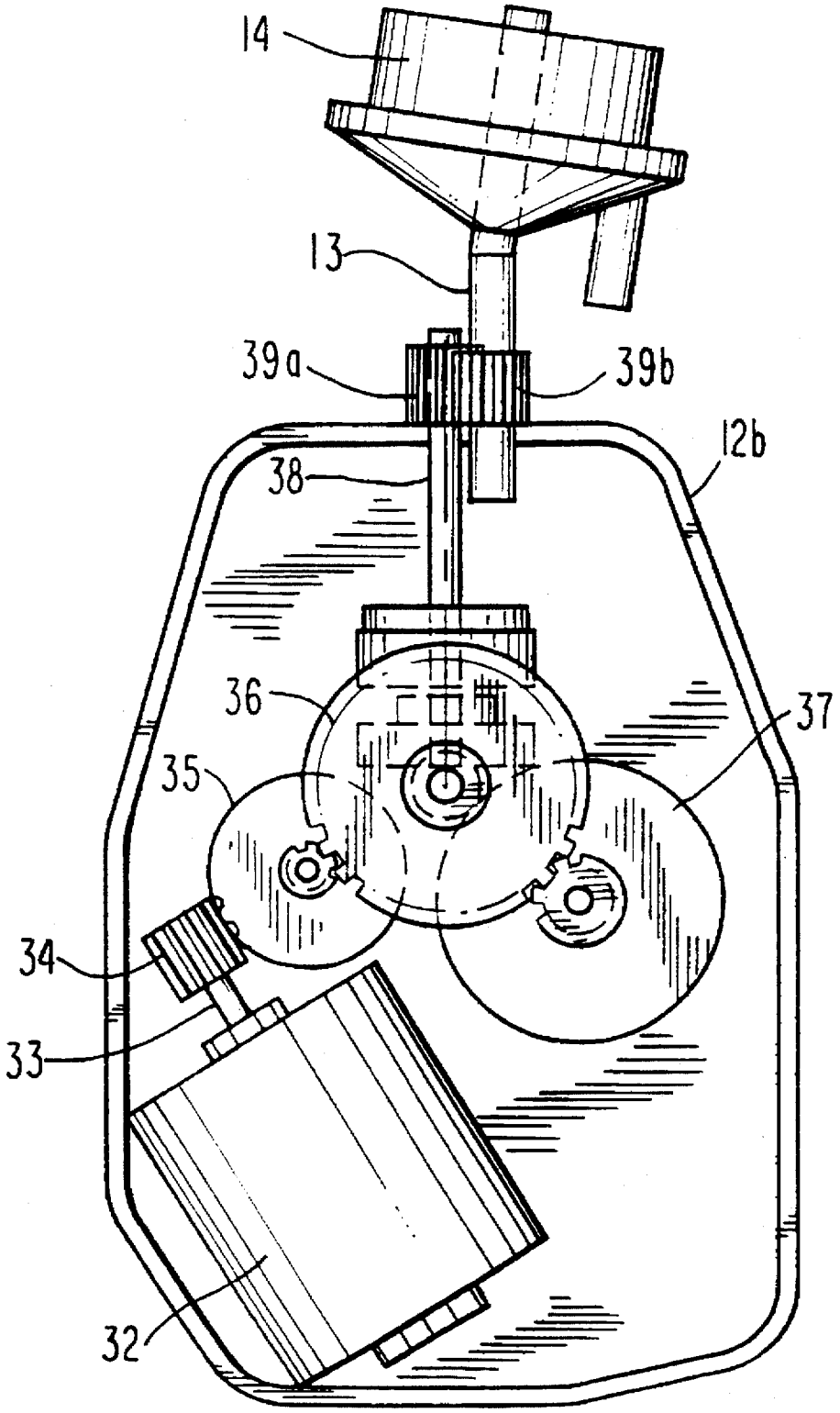
FIG. 7 shows an enlarged sectional view of the body casing member containing an electric motor and intermeshed gears; and taken at section 7—7 of FIG. 5.

FIG. 3 shows essentially the same pivoted lever mechanism of FIG. 1 except the mechanism is provided within a Santa FIG. 30 which includes a costume made of suitable fabrics and including arms and a head piece 30*a*. The Santa FIG. 30 is sitting on a chair 31 attached to a base member 44. FIG. 4 is similar to FIG. 2 but shows the mechanism provided within the Santa FIG. 30 in a standing position adjacent to the chair 31. The lever elements for FIGS. 3 and 4 are essentially the same as those shown and described for FIGS. 1 and 2. FIG. 5 shows an exploded view of the operating structure 10 including casing 12 and the interconnected lever members of FIGS. 1 and 3 in a sitting position. FIG. 6 similarly shows an exploded view of the casing 12 and interconnected lever members of FIGS. 2 and 4 when in a standing potion. The casing 12 is vertically split at joint 11 into two parts 12*a* and 12*b*. As best shown in FIG. 7, the casing part 12*b* contains an electric motor 32 mounted therein and has a rotatable shaft 33 and attached pinion gear 34. The pinion gear 34 meshes with a series of three intermeshed toothed gears 35, 36 and 37 each rotatably mounted within the casing 12. The final gear 37 is attached to the rotatable output shaft 16 which drives the dual rotors 20*a* and 20*b* provided on opposite sides of the casing 12. The final gear 37 also drives a central horizontal geared shaft 37*a*, which drives a vertical shaft 38 leading to interacting gears 39*a* and 39*b*, which drives the vertical bent rotatable rod 13 and attached head piece 14. The electric motor 32 is powered either from an electric 110 volt AC source and transformer (not shown) or preferably by dry cell type batteries 40, which are usually 2 "C" size batteries located in an enclosure 41 provided the bottom part of the chair 31 or in the base 44, and provide a power output of 3 volts. The casing 12 and lever members are all made of a light weight rigid molded plastic material such as nylon, polyethylene or polypropylene. Operation of the animated character 10 of this invention is controlled by an electric circuit including appropriate programmable elements. Animated movements of the character can be actuated either manually or by a light sensitive switch 42 in response to a motion signal such as produced by an object or person moving near the character. The operating switch 42 can be conveniently located in the forward portion of base member 44, onto which the chair 31 is rigidly attached such as by an adhesive material. The elements of the electrical circuit are mounted on a circuit board 46 which contains programmable timing provided either within the lower portion of the chair 31 or in the base member 44. The operating switch 42 for the electric circuit has three positions, as follows:

(a) - manual continuous operation.

(b) - automatic periodic operation actuated by nearby motions.

(c) - switch off(no power to character).

(a) Manual Operation

When the manual function switch is on, the Santa figure will repeat its movement again and again, i.e. by standing up slowly, swinging its head until the figure is in the upright position, then lifting its head and saying "HO-HO-HO Merry Christmas To All Girls and Boys". etc., then sitting down. This action is repeated until the operating switch is pressed or turned to some other position and function.

(b) Walk-By Activation

When pushing the operating switch to walk-by activation, the power will be on and the light sensitive switch will cause the Santa figure to stand up slowly from the chair and swing its head at the same time. As the body is near an upright position, Santa will look upward and say "HO-HO-HO Merry Christmas" or a similar statement or song for about 6 seconds, then sit down gradually to a standby status until reactivating occurs.

As the light-sensitive switch is activated by some person or an object passing by within about 2 meters distance, the Santa figure will be back to action again. It will stand up slowly from the chair and swing his head, and when near the upright position, lift his head to say "HO-HO-HO Merry Christmas To All Girls and Boys" and so forth, then sit down again on the chair and return the whole cycle to standby status. The cycle of light stimulated movements takes approximately 20 seconds.

(c) Off Status

When the operating switch is moved to the off position, the power is turned off (no consumption of power) and all actuation movements will stop immediately, even if the light controlled Santa figure is still on some stage of the movement cycle.

Although this invention has been described broadly and includes a preferred embodiment, it will be understood that modifications and variations can be made within the scope defined by the following claims.

We claim:

1. An animated character capable of moving repeatably from a sitting position to a standing position, comprising:

(a) a body including a torso casing member, said casing containing an electric motor rotatably connected to multiple intermeshed gears, and also having a first rotatable curved rod extending upwardly from the casing upper end, and having a second shaft extending outwardly from two opposite sides of the casing;

(b) a head core member attached to the first upper rotatable curved rod and capable of making side-to-side motions;

(c) dual rotors each attached to each end of said second side output shaft;

(d) dual first levers, each being pivotally attached at one end to said casing and pivotally attached at its other end to a corresponding one of said dual rotors;

(e) dual elongated second lever members each pivotably attached at its upper end to a corresponding one of said rotors, and each pivotally attached at its lower end to a vertical leg member; and (f) dual third lever members, each being pivotably attached at its upper end to said casing, pivotably attached at its midpoint to the midpoint of said second lever member, and pivotally attached at its lower end to the vertical leg member, whereby when said electric motor and said dual rotors are rotated, second lever member and each third lever member can be moved from a near horizontal to a vertical position so that the body of the animated character is movable from a sitting to a standing position.

2. The animated character of claim 1, wherein said casing member contains three intermeshed gears, and the first curved rotatable rod is connected to the third said intermeshed gear.

3. The animated character of claim 1, wherein the casing and lever members are formed of a rigid plastic material.

4. The animated character of claim 1, wherein said body includes a head piece fitted over said head core member.

5. The animated character of claim 1, wherein said body has the form of a Santa figure which is initially sitting in a chair on a base member.

6. The animated character of claim 1, wherein the body movements are controllable by an electric circuit including elements which control the frequency and rate of movements of the lever members and vocal sounds of the character.

7. The animated character of claim 6, wherein the electric circuit is controlled by a motion-sensitive switch.

8. The animated character of claim 6, wherein the electric circuit includes a circuit board member and is powered by batteries, all located within the character.

9. An animated character capable of moving repeatably from a sitting position to a standing position comprising:

(a) a body having the form of a Santa figure and including a torso casing member, said casing member containing an electric motor rotatably connected to multiple intermeshed gears and also having a first rotatable curved rod extending upwardly from the casing upper end, said casing having a second shaft extending outwardly from two opposite sides of the casing;

(b) a head core member attached to the first upper rotatable curved rod and capable of making side-to-side motions;

(c) dual rotors each attached to each end of said second side output shaft;

(d) dual first levers, each being pivotally attached at one end to said casing and pivotally attached at its other end to a corresponding one of said dual rotors:

(e) dual elongated second lever members, each pivotably attached at its upper end to a corresponding one of said rotors, and each pivotally attached at its lower end to a vertical leg member;

(f) dual third lever members each being pivotably attached at its upper end to said casing, pivotably attached at its midpoint to the midpoint of said second lever member, and pivotally attached at its lower end to the vertical leg member; and (g) an electric circuit including elements for controlling the electric motor and movements of the dual lever members, whereby when said electric motor and said dual rotors are rotated, each elongated second lever member and each third lever member can be moved from a near horizontal to a vertical position, so that the body of the animated character is movable from a sitting position to a standing position.

* * * * *